US009859049B2

(12) United States Patent
Lestician

(10) Patent No.: US 9,859,049 B2
(45) **Date of Patent: *Jan. 2, 2018**

(54) SYSTEM FOR REDUCING ELECTRICAL CONSUMPTION WITH TRIPLE CORE ITERATIVE TRANSFORMERS

(71) Applicant: Guy J. Lestician, East Stroudsburg, PA (US)

(72) Inventor: Guy J. Lestician, East Stroudsburg, PA (US)

(73) Assignee: BASIC POWER, INC., East Stroudsburg, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/998,791

(22) Filed: Feb. 18, 2016

(65) Prior Publication Data

US 2016/0322903 A1 Nov. 3, 2016

Related U.S. Application Data

(63) Continuation-in-part of application No. 13/999,752, filed on Mar. 19, 2014, and a continuation-in-part of application No. 13/999,481, filed on Mar. 4, 2014.

(51) Int. Cl.

| | |
|---|---|
| ***H01F 27/28*** | (2006.01) |
| ***H01F 17/06*** | (2006.01) |
| ***H01F 27/24*** | (2006.01) |
| *G05F 3/04* | (2006.01) |
| *H01F 30/08* | (2006.01) |

(52) U.S. Cl.
CPC ..... *H01F 17/062* (2013.01); *H01F 27/24* (2013.01); *H01F 27/2823* (2013.01); *G05F 3/04* (2013.01); *H01F 30/08* (2013.01)

(58) Field of Classification Search
CPC ..... H01F 38/18; H01F 38/30; H01F 38/26; H01F 6/006; H01F 30/10; H01F 30/12; H01F 30/16; H01F 19/04; H01F 19/08
USPC ..... 323/355–363; 363/12, 170–174, 180, 363/182–183, 213, 229
See application file for complete search history.

(56) References Cited

U.S. PATENT DOCUMENTS 6,037,686 A * 3/2000 Schonauer ..... H01F 37/00 310/68 R
7,573,253 B2 * 8/2009 Lestician ..... H01F 27/343 323/356

* cited by examiner

*Primary Examiner* — Nguyen Tran
(74) *Attorney, Agent, or Firm* — Deirda M. Meagher

(57) ABSTRACT

A system for reducing electrical consumption includes a connection to an incoming power supply of a facility, in parallel, including a hot line, and a neutral line, a ground. Components are connected between the hot line and the neutral line in this order: front capacitors front arc suppressors, at least one front metal oxide varistor line transient voltage surge suppressor having a predetermined capability to suppress undesired power spikes, at least two inductor/metal oxide varistor iterative transformers, at least one of these being a three component iterative transformer with three distinct windings, followed by other components.

20 Claims, 12 Drawing Sheets

SYSTEM FOR REDUCING ELECTRICAL CONSUMPTION WITH TRIPLE CORE ITERATIVE TRANSFORMERS

CROSS REFERENCE TO RELATED APPLICATION

This application is a continuation-in-part of copending U.S. application Ser. No. 13/999,481, filed on Mar. 4, 2014, and entitled INTERACTIVE TRANSFORMERS WITH COMPLEX TRIPLE WINDINGS AND SYSTEMS FOR REDUCING ELECTRICAL CONSUMPTION USING THE ITERATIVE TRANSFORMERS.

BACKGROUND OF INVENTION a. Field of Invention

The present invention relates to electrical power supply, and more particularly to a system for conserving electrical energy consumption in commercial, industrial, residential, or other energy consumption settings. The present invention system conserves electrical energy consumption with control devices at or near incoming power breakers to increase efficiency relating to loads, distortions, spikes and/or power factors, as well as other deviant characteristics. In addition, this present invention system with a three component iterative transformer that includes three cores and three interconnected windings, improves response time and results in more energy savings than the prior art electric power supply energy saving systems, including those previously developed by the present inventor.

In a typical electrical power consumption setting, electricity is transmitted via power lines or transmission lines to a facility, such as a factory, office, home, etc. The main electrical line is typically connected to a power meter, which in turn is connected to a main breaker box of the facility via a main line. Electricity is distributed to various loads of the facility through various individual circuit breakers in the main breaker box.

In general, and particularly in industrial settings, electrical loads, such as non-linear loads, including DC motors, create harmonic distortions, electrical spikes, and poor power factor, which have negative impact on efficiency and the condition of the load itself (e.g., overheating and reduced motor life). Other internal and external physical conditions also contribute to these and other deviant (inefficient) characteristics that adversely affect electrical consumption. Thus, the present invention is a system for reducing electrical consumption that includes one or more devices that recognize electromagnetic interference with means to suppress line transient voltage surges, means to regulate harmonics distortion, means to enhance power factor correction and means to maintain phase regulation by maintaining phase relationship between voltage and current at times of increased power demands, using newly discovered arrangements of components to achieve these results.

b. Description of Related Art

The following patents are representative of systems and devices for conservation of electric consumption:

U.S. Pat. No. 4,163,218 relates to an electronic control system for controlling the operation of a plurality of electrical devices which are energized from AC power lines which includes a single, central unit connected to the power lines, which further includes a central transceiver means for transmitting an encoded oscillating signal of one frequency onto the power lines, a central encoding means for encoding means for encoding the oscillating signal with an encoded signal in synchronization with the frequency of the AC power for selective control of electrical devices, and a central control means connected to the encoding means for selecting the electrical device to be controlled and its desired state. The invention further includes unitary switch units respectively interconnected between power lines and each electrical device being operative for both local and centralized control of the electrical device with the local control and the centralized control placing the electrical device in respective opposite states from each other, each switch unit including a switch transceiver means for receiving the encoded oscillating signal from the power lines, a switch decoding means coupled to the switch transceiver means for detecting the encoded signal, a switch control means connected to the switch decoding means for setting the selected electrical device to the desired state, and a local control means for selectively locally operating the electrical device independently of the central unit and placing the electrical device in a state opposite from that which it was placed by the central unit.

U.S. Pat. No. 4,845,580 describes a spike elimination circuit for A.C. and D.C. power sources which comprises two gas tubes and/or two semiconductor voltage limiting devices before a Bandpass Filter. The Bandpass Filter consists of 2 capacitors to ground and inductor in series with the line. The spike eliminator can be portable, mobile, or hard wired for the protection of home controls and electronics, telecommunications, commercial and industrial controls and the computer field and others.

U.S. Pat. No. 4,870,528 describes a surge suppressor which comprises a first series circuit having a first inductance and a first alternating voltage limiter, including at least a first capacitance and a bidirectionally conductive rectifying circuit for charging the first capacitance, coupled between first and second input terminals for limiting surge currents and voltage excursions coupled to first and second load output terminals. The first alternation voltage limiter further comprises a sensing circuit for sensing at least one of the charging current supplied to the voltage developed across the first capacitance. An auxiliary energy storage circuit and a normally open switching device responsive to the sensing circuit are provided for coupling the auxiliary energy storage circuit across the first capacitance during high energy surge conditions.

U.S. Pat. No. 5,105,327 describes a power conditioner for AC power lines which has a choke and capacitor coupled in series across the power lines. The choke comprises a coil termination in a line, with the line looped back through the coil. The power lines are thereby balanced to provide greater operating efficiency. Capacitors and transient suppressors (e.g. varistors) are used for transient suppression and power factor correction.

U.S. Pat. No. 5,420,741 relates to an arrangement for obtaining flux rate information in a magnetic circuit including passive means connected across a flux rate sensor for implementing control of said flux rate. The passive means being a tuned magnetic flux rate feedback sensing and control arrangement wherein impedance is tuned and the energy loss characteristic is adjustable. The selection of inductance and capacitance values provides tuning and the selection of resistance affects the energy loss characteristics.

U.S. Pat. No. 5,432,710 is directed to an energy supply system for supplying, in system interconnection, power at a power receiving equipment from a power plant and power generated by a fuel cell to a power consuming installation, and supplying heat generated by the fuel cell to a heat consuming installation. This system includes an operation amount computing device for computing an amount of operation of the fuel cell to minimize an equation y–aXL+bXM+cXN, in response to an energy demand of the power consuming installation and heat consuming installation A control device controls the fuel cell to satisfy the amount of the operation computed. The system supplies energy in optimal conditions with respect to the cost borne by an energy consumer, consumption of primary energy and release of environmental pollutants. Energy is effectively used from the standpoint of the energy consumer and a national point of view.

U.S. Pat. No. 5,436,513 relates to an information handling system which is described as having a power supply and having a switching circuit that switches a plurality of energy sources between series and parallel couplings. Associated with the switching circuit is a voltage level detecting circuit for monitoring the voltage level of the energy sources. A processor for controlling the information handling system responds to the voltage level detecting circuit and in the event of a low voltage condition the processor activates the switching circuit to switch the energy sources and from a series to a parallel coupling. Alternatively, the processor responds to other inputs or conditions for actuating the switching circuit.

U.S. Pat. No. 5,459,459 is directed to an algorithm for implementation in a meter register and a reading device. In the one embodiment, the invention enables selecting a display table to be read from the register, updating the billing read date and time in the register, reversing the order in which load profile data is transmitted from the register to the reader, specifying the number of load profile intervals to be read from the register and specifying the number of intervals to skip when reading from the register.

U.S. Pat. No. 5,462,225 relates to an apparatus and method for controlling energy supplied to a space conditioning load and for overriding a load control operation in response to measuring certain space temperatures within a closed environment. The load control apparatus includes a control device connected to an electrical distribution network and to a space/conditioning load and a temperature sensing device connected to the control device. The control device conducts a load shedding operation to control distribution of electrical energy to the space conditioning load in response to command signals supplied by a remote command center. The temperature sensing device operates to override the load shedding operation by outputting a control overriding signal to the control device tin response to sensing certain space temperatures within the closed environment. If the temperature control device is connected to an air conditioning system the temperature sensing device causes the control device to terminate the load shedding operation prior to expiration of a selected time period in response to measuring a space temperature that exceeds a maximum space temperature limit. In contrast, if the temperature control device is connected to a forced air beating system, the temperature sensing device causes the control device to terminate the load shedding operation when a measured space temperature drops below a minimum space temperature limit the maximum space temperature limit is greater than the control temperature setpoint of a thermostat that controls the space conditioning operations, whereas the minimum space temperature limit is less than the control temperature setpoint.

U.S. Pat. No. 5,483,672 relates to a communication system, where a communication unit may conserve source energy when it is inactive in the following manner. The control channel is partitioned into a predetermined number of windows and a system window which are transmitted on the control channel in a round robin manner. When the communication unit registers with the communication system, it is assigned to a window group. The communication unit then monitors only the system window to determine whether the window group that it's been assigned to is also assigned to one of the predetermined number of windows. When the window that has been assigned to the window group is being transmitted to the control channel the communication unit activates to monitor that window. Once the window is no longer being transmitted, the communication unit deactivates unit the system window is being transmitted or the window assigned to the window group is being transmitted.

U.S. Pat. No. 5,495,129 relates to an electronic device for multiplexing several loads to the terminals of a source of alternating electrical energy. The source of alternating electrical energy is coupled by electromagnetic flux to the loads by using primary excitation windings and connects to the terminals of the source of alternating electrical energy and secondary windings respectively corresponding to the number of loads. The secondary windings are at least partially coupled to the primary winding and are each connected to the terminals of a load. The coupling is inhibited by auxiliary winding which are each totally coupled with the secondary winding. The inhibition function is controlled in order to inhibit all the magnetic couplings except for one and this particular one changes as a function of the respective loads to be coupled to the source of alternating electrical energy.

U.S. Pat. No. 5,512,831 relates to a system for testing electrochemical energy conversion and storage devices includes means for sensing the current from the storage device and varying the load across the storage device in response to the current sensed. The system is equally adaptable to batteries and fuel cells. Means is also provided to sense system. Certain parameters are then stored in digital form for archive purposes and certain other parameters are used to develop control signals in a host processor.

U.S. Pat. No. 5,517,188 is directed to a programmable identification apparatus, and associated method, includes a transceiver and a transponder. The transponder is powered by the energy of a transceiver transmit signal generated by the transceiver and includes a programmable memory element. A coded sequence which uniquely identifies the transponder is stored in the programmable memory element and, when transponder is powered, the transponder generates a transponder signal which includes the coded sequence stored in the programmable memory element, once modulated by circuitry of the transponder.

U.S. Pat. No. 5,528,123 measures the total line current in a power cord which is used to energize both a power factor corrected system and a non-power factor corrected AC loads. The power factor control loop of the power factor corrected system is then driven to correct the power factor of total line current in the power cord ideally to approach unity.

U.S. Pat. No. 5,640,314 relates to a symmetrical ac power system which provides a balanced ac output, whose maximum voltage with respect to a reference ground potential is one-half the ac output voltage, and which is derived from a single phase ac source through the use of an isolation transformer having a center-tapped secondary winding. The center tap is connected to the output power load circuit as a ground reference potential with respect to the symmetrical ac output so as to constitute the reference ground potential for the power supply and load. Since symmetrical ac power is applied to the load by the system, reactive load currents, other power artifacts, EMI and RFI emissions and other interference and noise components ordinarily resulting from the application of conventional ac power to the load are reduced or eliminated by appearing as equal inversely phased signal elements which cancel one another. In order to maximize the performance of the symmetrical power system, the isolation transformer has a bifilar-wound secondary winding.

U.S. Pat. No. 5,646,458 describes a UPS (uninterruptible power system) which includes an UPS power conditioning unit that provides conditioned AC power to a critical load. The UPS power conditioning unit includes a variable speed drive that operates in response to AC utility power or to a standby DC input by providing a motor drive signal. The UPS power conditioning unit further includes a motor-generator that operates in response to the motor drive output by providing the conditioned AC power to the critical load. In response to an outage in the utility AC power, standby DC power is provided by a standby DC power source that includes a variable speed drive and a flywheel motor-generator connected to the variable speed drive. Both the UPS power conditioning unit and the standby DC power source are initially operated in response to the utility AC power, the flywheel motor-generator storing kinetic energy in a rotating flywheel. When an outage occurs, the rotating flywheel continues to operate the flywheel motor-generator of the standby DC power source, causing the production of AC power which is rectified and provided as standby DC power to operate the variable speed drive of the UPS power conditioning unit either the utility AC power outage is over or a standby emergency generator is brought on line.

U.S. Pat. No. 5,880,677 relates to a system that monitors and controls electrical power consumption that will be retrofitted to a typical consumer electrical power arrangement (typical arrangement-electrical feed line from a provider, a meter, a circuit breaker and individual input wiring to a plurality of electrical devices, appliances and outlets). The system includes a control unit which receives information from an electromagnetic pickup device from which real time electrical consumption is determined over very short periods of time. The control unit has a main data processing and storage processor for retaining information and it may include a communication microprocessor for sending signals to corresponding modules. The electromagnetic pickup device uniquely measures the electromagnetic flux emanating at each output wire from each of the individual circuit breakers in a breaker box. The modules have filters which release electrical power to the individual electrical devices, appliances and outlets at a controlled, economic rate.

U.S. Pat. No. 5,892,667 describes a symmetrical as power system which provides a balanced ac output, whose maximum voltage with respect to a reference ground potential is one-half the ac output voltage, and which is derived from a single phase ac source through the use of an isolation transformer having a center-tapped secondary winding. The center tapped is connected to the output power load circuit as a ground reference potential with respect to the symmetrical ac output so as to constitute the reference ground potential for the power supply and load. Since symmetrical ac power is applied to the load by the system, reactive load currents, other power artifacts, EMI and RFI emissions and other interference ad noise components ordinarily resulting from the application of conventional ac power to the load are reduced or eliminated by appearing as equal inversely phased signal elements which cancel one another. In order to maximize the performance of the symmetrical power system, the isolation transformer has a bifilar-wound secondary winding.

U.S. Pat. No. 6,009,004 discloses a new single-phase passive harmonic filter for one or more nonlinear loads. The filter improves the total system performance by drastically reducing the line side current harmonics generated by nonlinear loads. The filter includes two inductive portions across one of which is connected a tuning capacitor. The parallel combination of one inductive portion which the tuning capacitor forms a series tuned filter configuration while the second inductive portion is used for harmonic attenuation. A shunt capacitor is employed for shunting higher order harmonic components. A single-phase passive voltage regulator provides the needed voltage bucking to prevent over voltage at the load terminals of the filter. The filter provides an alternate path for the harmonic current generated by nonlinear loads. The over voltage caused by the increased capacitive reactance is controlled by either capacitor switching or by the use of the passive voltage regulator or a combination of the two. Capacitor switching is dependent upon load conditions.

U.S. Pat. No. 6,014,017 describes a method and an apparatus for power factor correction for a non-ideal load, which is supplied for a main power supply, by a compensation device which is electrically connected in parallel with the load and has a pulse converter with at least one capacitive store. A transfer function space vector is calculated as a function of a determined mains power supply voltage space vector, a mains power supply current space vector, a compensator current space vector and of an intermediate circuit voltage which is present on the capacitive store. As a result of which the pulse converter generates a compensator voltage space vector on the main power supply side as a function of the intermediate circuit voltage. A compensator current space vector, that keeps the undesirable reactive current elements away from the mains power supply, is thus obtained via a coupling filter that is represented as a compensator inductance.

U.S. Pat. No. 6,058,035 describes a method wherein after starting the input of a switching signal to a booster circuit whose boosting rate is changeable in accordance with the duty ratio of the inputted switching signal and calculating the output power of an inventor circuit, which is connected to the subsequent stage of the booster circuit, from the output current of the inverter circuit, the target voltage after boosting by the booster circuit is obtained based on the output power. If the actual output voltage of the booster circuit is lower than the target voltage, the duty ratio of the above switching signal is increased, and if higher, the duty ratio of the above switching signal is decreased.

U.S. Pat. No. 6,384,583 B1 is a system including, in-parallel connection to an incoming power supply of a facility including a hot line and a neutral line, and at least one ground. There are components connected between the hot line and the neutral line in the order of front metal oxide varistors; line transient voltage surge suppressor having to suppress undesired power spikes; at least one capacitor of predetermined capacitance; at least two dual chokes in the form of inductor/metal oxide varistor transformers; at least a second capacitor of its own predetermined capacitance; metal oxide varistors having a predetermined capability. In preferred embodiments, the metal oxide varistor may be a plurality of varistors in parallel; a failure indicator circuit connected to the transient voltage surge suppressor, including at least one relay, one voltage-surge responsive switch and one indicator signaling component.

U.S. Pat. No. 6,448,747 B1 is an electricity pod controller device that includes in-parallel connection to an incoming power supply of a facility including a hot line and a neutral line, and at least one round. There are components connected between the hot line and the neutral line. At least one front metal oxide varistor line transient voltage surge suppressor has a predetermined capability to suppress undesired power spikes and at least one capacitor of predetermined capacitance is also included. At least two dual chokes in the form of inductor/metal oxide varistor transformers, a second capacitor of its own predetermined capacitance and at least one metal oxide varistor having a predetermined capability. In preferred embodiments, the metal oxide varistor may be a plurality of varistors in parallel.

U.S. Pat. No. 7,573,253 B2 to Lestician describes a system for managing electrical consumption that includes a connecting means for connection to an incoming power supply of a facility, for connection in parallel, including a hot line and a neutral line, and at least one ground. The following components are connected between the hot line and the neutral line. They are connected in the order of at least one front capacitor of predetermined capacitance, at least one front arc suppressor, at least one front metal oxide varistor line transient voltage surge suppressor having a predetermined number of joules capability to suppress undesired power spikes, at least two inductor/metal oxide varistor iterative transformers, at least a second capacitor of its own predetermined capacitance, at least one metal oxide varistor having a predetermined number of joules capability and at least two capacitors, each having its own predetermined capacitance different form one another.

Notwithstanding the prior art, the present invention is neither taught nor rendered obvious thereby.

SUMMARY OF INVENTION

The present invention solves the problems and overcomes the drawbacks and deficiencies of prior art surge suppressors and voltage regulators that failed to address different types of phase angle and harmonics problems, and do not adequately respond to simultaneous or near simultaneous multiple power difficulties.

The present invention, a system for reducing electrical consumption, includes a connecting means for connection to an incoming power supply of a facility, for connection in parallel, including a hot line and a neutral line, and at least one ground. The following components are connected between the hot line and the neutral line. They are connected in the order of: at least one front capacitor of predetermined capacitance and with a resistor; at least two front arc suppressors; at least one front metal oxide varistor line transient voltage surge suppressor having a predetermined number of joules capability to suppress undesired power spikes; at least two inductor/metal oxide varistor iterative transformers; at least a second capacitor of its own predetermined capacitance; at least one metal oxide varistor having a predetermined number of joules capability; and at least two capacitors each with a resistor, and each having its own predetermined capacitance different form one another. The at least two inductor/metal oxide varistor iterative transformers include a three component iterative transformer having: I.) a first magnetic coil core; II.) a second magnetic coil core; III.) a third magnetic coil core; IV.) a first incoming wire being wrapped around a portion of each of said first, second and third magnetic coil cores; V.) a second incoming wire being wrapped around a portion of each of said first, second and third magnetic coil cores; and, VI.) a third incoming wire being wrapped around a portion of each of said first, second and third magnetic coil cores.

By "iterative transformer" is meant a transformer that acts as a choke or clamp and is capable of simultaneous multiple power difficulties by iteratively making corrections and then correcting the corrections that have been affected by other difficulties. In other words, the arrangement of the component in the present invention system, device and transformers include means and capabilities for correcting intrusive errors to corrections. Additionally, the present invention systems, devices, and iterative transformers function not only at standard 60 hertz cycles but will function very well within a broad range of different cycles including 30 hertz to 400 hertz.

In some embodiments of the present invention system for reducing electrical consumption, the three component iterative transformer includes: I.) the first magnetic coil core being selected from the group consisting of a one piece loop and a multi-piece loop; II.) the second magnetic coil core being selected from the group consisting of a one piece loop and a multi-piece loop; III.) the third magnetic coil core being selected from the group consisting of a one piece loop and a multi-piece loop; IV.) said first incoming wire being wrapped in a first plurality of windings around a portion of said first magnetic coil core and then traversing a predetermined distance between and to said second magnetic coil core and then being wrapped in a second plurality of windings around a portion of said second magnetic coil core and continuing away from said second magnetic coil core and then traversing a predetermined distance between and to said third magnetic coil core and then being wrapped in a third plurality of windings around a portion of said third magnetic coil core and continuing away from said third magnetic coil core; V.) a second incoming wire being positioned along a portion of the external periphery of said first magnetic coil core and under said first plurality of windings of said first incoming wire, and then passing linearly to said second magnetic coil core and then being wrapped in a plurality of windings around a portion of said second magnetic coil core away from and opposite said first incoming wire second plurality of windings, and then passing linearly to said third magnetic core and then being wrapped in a plurality of windings around a portion of said third magnetic coil core away from and in the same direction as said first incoming wire plurality of windings and continuing away from said third magnetic coil core; VI.) a third incoming wire being wrapped in a first plurality of windings around a portion of said first magnetic coil core and then traversing a predetermined distance between and to said second magnetic coil core and then being wrapped in a second plurality of windings around a portion of said second circular magnetic coil core and continuing away from said second circular magnetic coil core and then traversing a predetermined distance between and to said third magnetic coil core and then being wrapped in a third plurality of windings around a portion of said third magnetic coil core and continuing away from said third magnetic coil core, wherein said third incoming wire is positioned as to each of said first and second incoming wires in a position selected from the group consisting of atop; adjacent; under and combinations thereof.

The present invention system for reducing electrical consumption includes a device that may have a plurality of front metal oxide varistors in parallel. In some preferred embodiments, it may have a plurality of capacitors having different capacitances at its back end.

In some embodiments of the present invention system for reducing electrical consumption, the system further includes the following components: i.) at least one resistor having a predetermined resistance.

The components may be arranged for operating as a single phase device. And the components may be duplicated to create two connected sets that are arranged for operation as a two phase device that may also include at least one additional resistor having a predetermined resistance. The components may be triplicated to form three connected sets that are arranged as a three phase device that includes at least one additional resistor having a predetermined resistance.

In some embodiments of the present invention system for reducing electrical consumption, the at least a second metal oxide varistor is a plurality of metal oxide varistors in parallel.

In some embodiments of the present invention system for reducing electrical consumption, the at least a second capacitor is a plurality of capacitors having different capacitances.

In other preferred embodiments, the present invention is a three component iterative transformer that includes I.) a first magnetic coil core; II.) a second magnetic coil core; III.) a third magnetic coil core; IV.) said first incoming wire being wrapped in a first plurality of windings around a portion of said first magnetic coil core and then traversing a predetermined distance between and to said second magnetic coil core and then being wrapped in a second plurality of windings around a portion of said second magnetic coil core and continuing away from said second magnetic coil core and then traversing a predetermined distance between and to said third magnetic coil core and then being wrapped in a third plurality of windings around a portion of said third magnetic coil core and continuing away from said third magnetic coil core; V.) a second incoming wire being positioned along a portion of the external periphery of said first magnetic coil core and under said first plurality of windings of said first incoming wire, and then passing linearly to said second magnetic coil core and then being wrapped in a plurality of windings around a portion of said second magnetic coil core away from and opposite said first incoming wire second plurality of windings, and then passing linearly to said third magnetic core and then being wrapped in a plurality of windings around a portion of said third magnetic coil core away from and in the same direction as said first incoming wire plurality of windings and continuing away from said third magnetic coil core; VI.) a third incoming wire being wrapped in a first plurality of windings around a portion of said first magnetic coil core and then traversing a predetermined distance between and to said second magnetic coil core and then being wrapped in a second plurality of windings around a portion of said second circular magnetic coil core and continuing away from said second circular magnetic coil core and then traversing a predetermined distance between and to said third magnetic coil core and then being wrapped in a third plurality of windings around a portion of said third magnetic coil core and continuing away from said third magnetic coil core, wherein said third incoming wire is positioned as to each of said first and second incoming wires in a position selected from the group consisting of atop; adjacent; under and combinations thereof.

In some preferred embodiments, in the three component iterative transformer, the first magnetic coil core and the second magnetic coil core and the third magnetic coil core are split half-rectangles of equal size.

In some preferred embodiments, the second incoming wire, after its first plurality of windings and before its second plurality of windings, is positioned atop the first plurality of windings of the first incoming wire.

In some preferred embodiments, the three component iterative transformer of the first incoming wire is a black or colored wire having an inductance within the range of about 1.0 to about 37 millihenries, plus or minus ten percent and the second incoming wire is a white wire having an inductance of about 1.0 to about 37 millihenries, plus or minus ten percent. The first incoming wire, the second incoming wire, and the third incoming wire may of the same gauge wires in some preferred embodiments.

In some preferred embodiments, the present invention system for reducing electrical consumption includes a main housing having a plurality of bins, each of the plurality of bins having a three component iterative transformer including: I.) a first magnetic coil core; II.) a second magnetic coil core; III.) a third magnetic coil core; IV.) said first incoming wire being wrapped in a first plurality of windings around a portion of said first magnetic coil core and then traversing a predetermined distance between and to said second magnetic coil core and then being wrapped in a second plurality of windings around a portion of said second magnetic coil core and continuing away from said second magnetic coil core and then traversing a predetermined distance between and to said third magnetic coil core and then being wrapped in a third plurality of windings around a portion of said third magnetic coil core and continuing away from said third magnetic coil core; V.) a second incoming wire being positioned along a portion of the external periphery of said first magnetic coil core and under said first plurality of windings of said first incoming wire, and then passing linearly to said second magnetic coil core and then being wrapped in a plurality of windings around a portion of said second magnetic coil core away from and opposite said first incoming wire second plurality of windings, and then passing linearly to said third magnetic core and then being wrapped in a plurality of windings around a portion of said third magnetic coil core away from and in the same direction as said first incoming wire plurality of windings and continuing away from said third magnetic coil core; VI.) a third incoming wire being wrapped in a first plurality of windings around a portion of said first magnetic coil core and then traversing a predetermined distance between and to said second magnetic coil core and then being wrapped in a second plurality of windings around a portion of said second circular magnetic coil core and continuing away from said second circular magnetic coil core and then traversing a predetermined distance between and to said third magnetic coil core and then being wrapped in a third plurality of windings around a portion of said third magnetic coil core and continuing away from said third magnetic coil core, wherein said third incoming wire is positioned as to each of said first and second incoming wires in a position selected from the group consisting of atop; adjacent; under and combinations thereof.

There may be a plurality of bins for the transformers that may have divider walls between each of the three component iterative transformers that include a conductive metal plate having opposite sides covered with a non-conductive material. The divider walls may include grounded aluminum plates. The non-conductive materials may be composite deck boards. The divider walls may include a grounded aluminum plate sandwiched between insulative materials, such as electronic component grade paper, composite deck boards wherein each insulative composite deck board is about 1/16.sup.th to 3/16.sup.th inches thick or other effectively insulative material.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Overview

Figure 1:
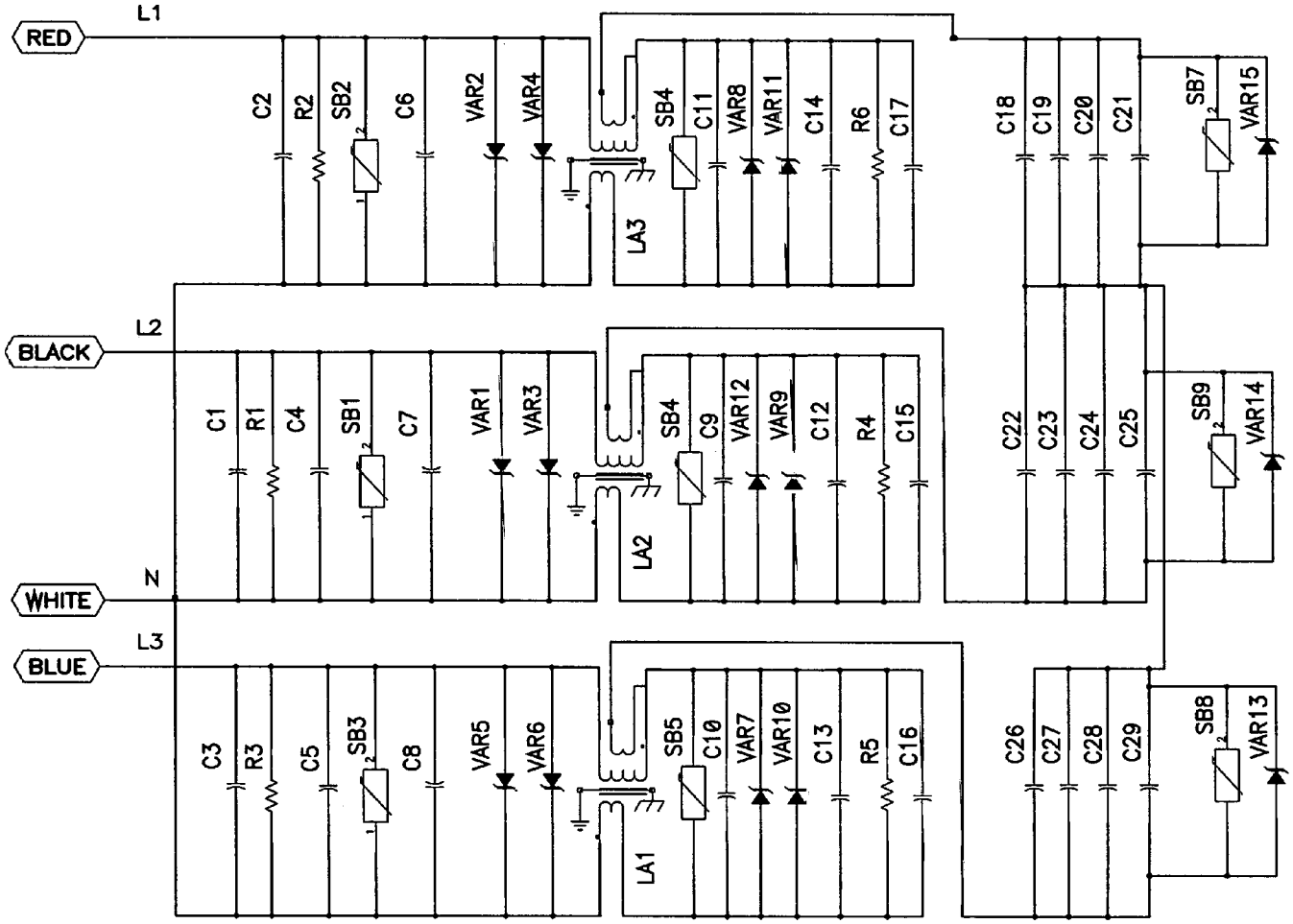
FIG. 1 illustrates a schematic diagram of a system for reducing electrical consumption utilizing triple core iterative transformers in accordance with an embodiment of the present invention, for a three phase power unit.

In one preferred embodiment, the present invention is a system that is in line with AC Incoming Voltage to an electrical load site, such as an industrial, commercial, educational or recreational facility. A typical electrical supply arrangement includes an electrical feed line from the service provider connected to all of the electrical devices in a particular location, as in the case of circuit breakers for the main source or for fuel cells or generators for large motors.

In one implementation, the system is attached at the main source for such things as large motors and motor driven systems. It is connected in a manner that reduces the harmonics in a building; lowering the total harmonic distortion (ThD) to a very low value and adjusting any low Power Factor so as to be adjusted to 0.95 or greater. Included is a Transient Voltage Surge Suppressor (TVSS) with a feature to reduce the spikes that can be portable, mobile, or hard wired, for the protection of the location.

With this in mind, the present invention system can reduce the demand for power by controlling the noise factor and regulating electrical surges and sags in a building, thereby lowering the energy consumption. The present invention system also has the ability to work with large generators and with fuel cell systems for preventing a loss of voltage and current in a given situation and maintaining power requirements needed for short periods of time. In the generator, the system not only reduces kilowatt usage being drawn but also reduces its need for fuel consumption. In the fuel cell, the system is able to suppress the surge/sag, which results in more efficiency for the fuel cell to produce more energy.

In one implementation, a parallel AC power system helps provide a balanced AC load to the potential electrical feed to the building or power supplied by the utility company by means of an electrical enclosure with its electrical parts. It is installed parallel to the main load and/or to the motors drawing the most power. It acts as a voltage and current absorber and corrects a poor power factor. It also improves the THD (Total Harmonic Distortion).

When this present invention system is connected in parallel to the source, it decreases the phase angle of current and voltage. If voltage or current are out of phase it adjusts to proper phase. This system reduces power consumption and responds to the load by means of its current draw and adjusts to the demand by lowering its storage mechanisms. It adjusts the voltage to its current demands by giving the device a supply of voltage, which results in lower demand on usage of its power consumption.

Principles of the present application are particularly applicable to industrial settings with high current demands (e.g., with loads drawing up to 5,000 Amps). It should be recognized, however, that principles of the present invention are applicable to other electrical load settings, from the largest industrial and commercial applications to small residential and ancillary building electrifications.

EXAMPLES

FIG. 1 is a schematic diagram illustrating an electrical power conditioning system in accordance with an embodiment of the present invention. The schematic diagram of FIG. 1 is a three phase arrangement, although it should be recognized that the principles embodied in the arrangement illustrated in FIG. 1 are applicable to a single phase arrangement, a two phase arrangement, etc. In FIG. 1, the "White" line is a neutral line, and the "Red," "Blue," "Black" and "Green" are so-called "hot lines" or "hot legs." Although FIG. 1 includes specific values for circuit elements illustrated therein, in should be realized that these are exemplary values and that these values may vary depending on the particular electrical power distribution environment.

Generally, the arrangement of FIG. 1 employs a generating means connected in a paralleling noise reduction unit to the incoming power source from Red, Blue and Black lines. The White lines are preferably connected to the Green lines for beneficial grounding that enhances the functioning of the present invention devices and systems.

Capacitors C1, C2, C3, C12, C13, C14 (which are a dry film type according to one preferred present invention embodiment implementation) are connected in parallel to the front end of the unit. This helps in the reduction of the lower harmonic noise on the fundamental frequency (e.g., 30 Hz to 400 Hz) input lines. This type of arcing band pass filter, (filter capacitors) are intolerant of reverse current and heat. Run type capacitor working voltage [WV] ratings should be treated with respect. The WV rating is virtually the maximum voltage rating. Despite their more delicate nature, these filter capacitors offer substantial advantages over electrolytic filter capacitors. The main advantages are more joules of energy storage per capacitor, reduced weight and reduced volume. This combination with the dry caps is called an "Arcing Setup" in a circuit with the installed MOVs. When the capacitors are operated in series, they should share the voltage equally. In order to do this, a voltage equalizer resistor is connected across each capacitor. The equalizer resistor comes with the caps on them or in them. In FIG. 1, capacitors C6, C7, C8, C12, C13 and C14 (which are oil type capacitors for high current use according to an embodiment of the present invention) function to remove the lower fundamental frequencies of the harmonic bands with a filter for high frequency spikes, sparking and transients with a snubber network, SB1, CSB2 and SB3 (which are Quencharc type according to an embodiment of the present invention), in the circuit helping to reduce noise created by motors running on that panel box.

Capacitors C5, C6, C7, C8 (which are oil type capacitors for high current applications according to an embodiment of the present invention) are connected in series to allow for more current to pass; in addition the needed values will be half the capacitance but will allow for more current to pass through them and prevent damage to the capacitors in this manner from the harmonic noise still passing through them. The MOVs (metal oxide varistors) VAR1, VAR2, VAR3, VAR4, VAR5, VAR6 are for the transients spikes from the input line and also reduce the transponder non-fundamental frequencies for the AC line suppression for creating a very clean EMI/RFI reduction from the power lines.

Arranging three component chokes LA1, LA2, LA3 in series on the Hot legs (Red, Blue, Black and Green) creates a low pass filter or other non-fundamental frequency currents flowing to the load but opposite in phase; filter for as setting up a current load to the source for balancing of the phases being applied to capacitors C9, C10, C11 (which are oil type capacitors according to an embodiment of the present invention). This large LC type network creates a network where the current being drawn by the incoming load reacts with the power factor; this will create an imbalance load in the case of offset lagging current and creating a current generating means in which the excess power is then converted to power from the fundamental frequency then supplied back to the AC power source, which may include a generator or fuel cell.

With MOVs VAR7, VAR8, VAR9, VAR10, VAR11, VAR12 across the leading current, the MOV's now can reduce the major part of the voltage transients whereas the current now will be reduced at the source. Capacitors C15, C16, C17 (which are oil type capacitors for high current according to an embodiment of the present invention) are provided in the circuit for added protection of the stray harmonics that could damage the upcoming capacitance stage, whereas this will keep the capacitors from having more current through them to prevent an unwanted catastrophic failure. The output stage with one or more capacitors is acting as a Voltage/Current storage device; wired as a "Y" or delta configuration sets up a Kvar injection to the incoming source for proper balancing of all voltage and current fields across the current power source. The resistors R4, R5, R6 in conjunction with a lamp, displays an indication for that phase which is active.

Paralleling up to 12 of these device stages together across the 3 phases and injection of 1000 to 50000 Kvar's to the power source with great response with less noise created by the motors, resistive loads and the inductive loads; this nonlinear loading represented by non-fundamental frequency load currents in the source; the demand with harmonics on a given location creating a larger bill to the customer and not really using that demand. This will bring the demand down on a building with the reduction of harmonics, thereby stabilizing the building with cleaner AC power in the building.

The first stage of the system illustrated in FIG. 1 functions as an EMI/TVSS section for all suppressors needed for incoming voltage spikes. This band pass filter reacts to the line load by injection of Kvar's to the source. The second stage of the system illustrated in FIG. 1 acts as a variable inductor filter to handle the THD and the power factor of the line loads. The last stage of the system illustrated in FIG. 1 creates storage capacity to keep the unit under load with a voltage/current reserve for unexpected surges and sags.

Significantly, this system lowers the harmonics being produced by the motor (in the case in which the load is a motor), thereby greatly reducing the current being consumed. As an additional benefit, this keeps the motor running cooler, hence reducing the wear and tear on the motor. Furthermore, there is achieved a reduction of energy being used by means of Kw (kilowatt hours) through lowering the demand from its source. Energy savings will occur with all of these key features working together; the result being a significant (e.g., 10 to 30%) reduction of energy used by the consumer and less maintenance on motors with a cleaner energy going back to the utility company supplying the power.

Three Component Choke Design

According to an embodiment of the present invention, three component (i.e., three core) chokes LA1, LA2, and LA3 are configured using a coil design as described herein below. Generally, a coil design according to this embodiment of the present invention employs a generating means of detecting the current in the paralleling noise reduction unit to the incoming power source. In one implementation, each coil is situated in an upright position and is constructed with the following components for its makeup: three magnetic coil cores (which may be circular, rectangular, or otherwise, and which may be a single piece or an arrangement of pieces with or without spacing to create a coil loop (core)), e.g., sets of rectangular half coil pairs (a coil is established when the two split half rectangles are positioned with opposing ends facing each other). The wire is being used may preferably be a "THWN" gas and oil type wire.

The direction of the wire from the white (Neutral) is wound in a proper manner for the magnet flux fields and have this conformingly to the windings. The Hot legs using a color such as (Black, Red, Blue) also follow this winding pattern for proper operation. This has the most effect on the loads being applied to for the direction of the currents being picked up from the source. The reaction of the white (Neutral) plays a role in where this reduces the amount of frequencies where as it puts the phasing at 180 degrees out of phase to the incoming hot leg. The means of winding the hot also places a 90 degree phase from the white, and thus counteracts the flow of current and the harmonic frequencies out of phase to the coil reactor in the circuit. This sets up the current sensing device for the voltage and the current sensing whereas it removes the fundamental frequency component acting in a manner as a notch filter device to the applied circuit; its power efficiently flows in either direction between its output storage capacitors in the circuit. Like a notch filter, this removes the fundamental frequencies and controls the current source by injecting a current back into the AC power line from the storage capacitors connected in a manner like a "Y" or Delta stage in the unit. This method can be called as a reactor or a means of controlling the harmonics in a given power source for means of saving energy and the reduction of harmonics that reduces the capacitors life a great deal in a circuit. This also can be used as a current detection method in which it can replace a "CT" clamp used to detect the current in a given circuit without clamping it to the incoming line.

Figure 2:
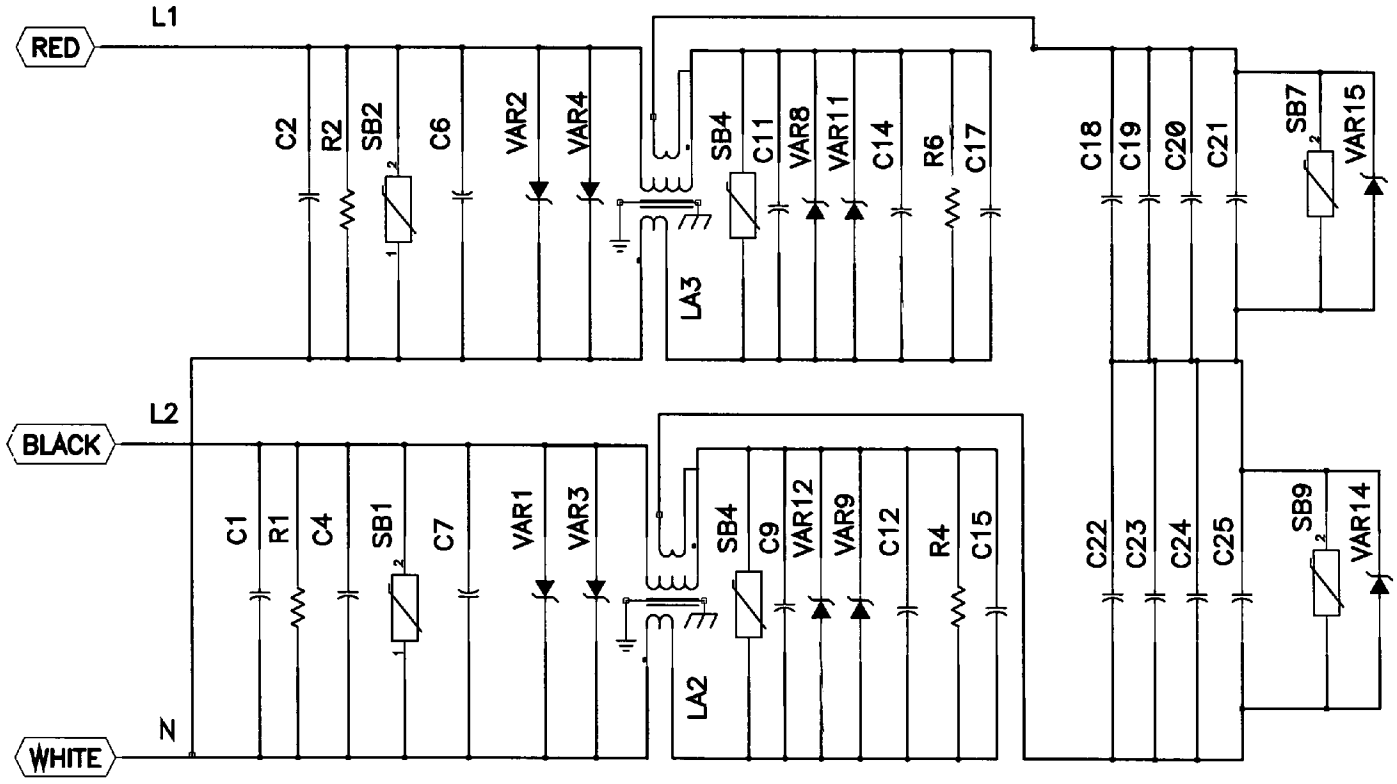
FIG. 2 illustrates a schematic diagram of a system for reducing electrical consumption utilizing triple core iterative transformers in accordance with an embodiment of the present invention, for a two phase power unit.

FIG. 2 shows a preferred present invention System for reducing electrical consumption utilizing triple core iterative transformers, for a two phase unit. Thus, ⅔ of the components and arrangements are identical to the arrangements and values set forth in the top ⅔ of Figure one described above this all of the components and related values shown in FIG. 1 that pertain to the FIG. 2 components are identical and need not be repeated.

Figure 3:
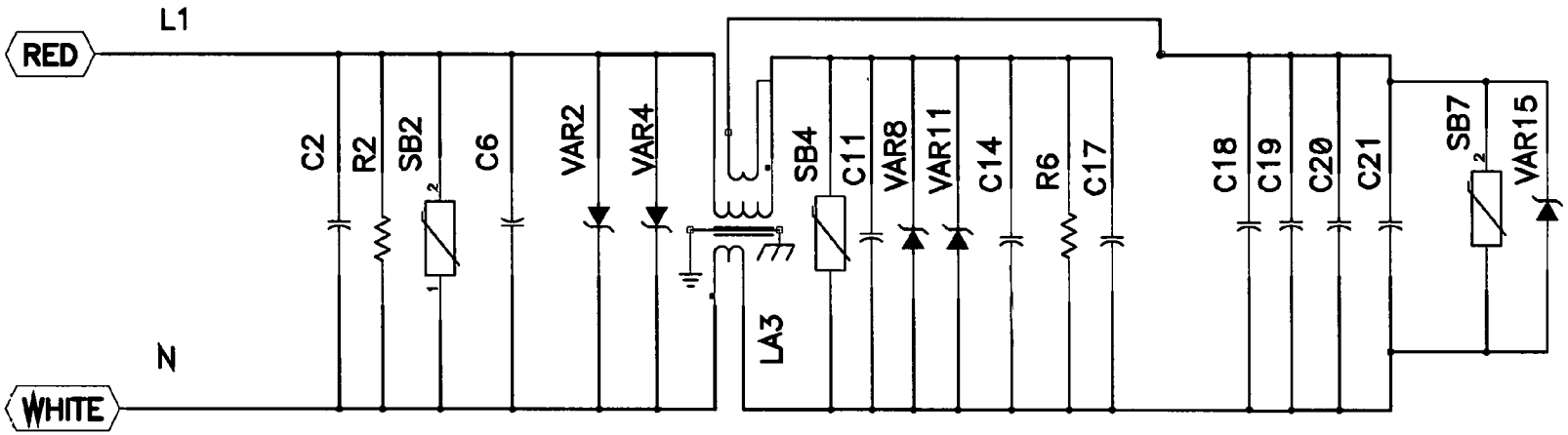
FIG. 3 illustrates a schematic diagram of a system for reducing electrical consumption utilizing triple core iterative transformers in accordance with an embodiment of the present invention, for a one phase power unit; and, FIG. 4 shows a schematic diagram illustrating features of some preferred embodiment present invention system for reducing electrical consumption utilizing triple core iterative transformers.

FIG. 3 shows a preferred present invention System for reducing electrical consumption utilizing triple core iterative transformers, for a one phase unit. Thus, ⅓ of the components and arrangements are identical to the arrangements and values set forth in the top ⅓ of Figure one described above this all of the components and related values shown in FIG. 1 that pertain to the FIG. 2 components are identical and need not be repeated.

Figure 4:
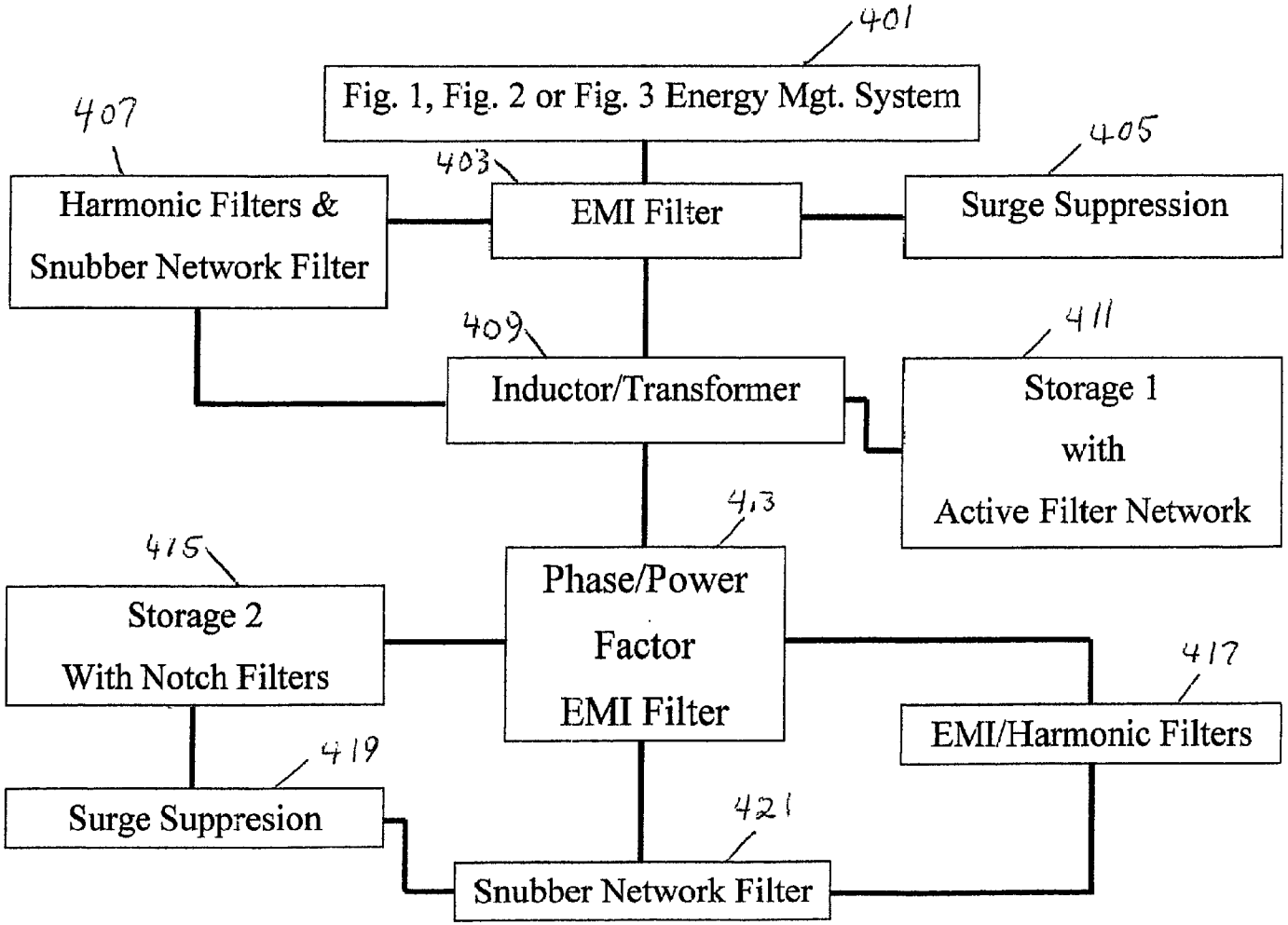

FIG. 4 shows a schematic diagram that illustrates the preferred embodiments of the present invention system showing the essential electronic features. AC power comes into a facility with a main breaker box and is then fed through an appropriate present invention System, block 401, for reducing electrical consumption. By "appropriate" is meant the correct size and model for a one phase, two phase, or three phase service. Thus, as shown in block 401, the system may be a FIG. 1 (three phase), FIG. 2 (two phase) or a FIG. 3 (one phase) configuration. In other words, the present invention system of block 401 may be any of the configurations described above—those shown in FIGS. 1, 2, and 3, as well as similarly functional variations and equivalents thereof. FIG. 4 now illustrates, with boxes and connecting lines, the various electronic functions and relationships described above. They include harmonic filter 403, with surge suppression 405, and harmonic filters and snubber network filter 407, interacting with inductor/transformer 409 with first power storage 411. Power factor correction, i.e., phase/power factor 413 includes an EMI filter and is connected to both second power storage 415 with notch filters. Surge suppression 419, EMI/harmonic filters 417 and snubber network filter 421 are interconnected with the phase/power factor 413 and each other, as shown.

Figure 5:
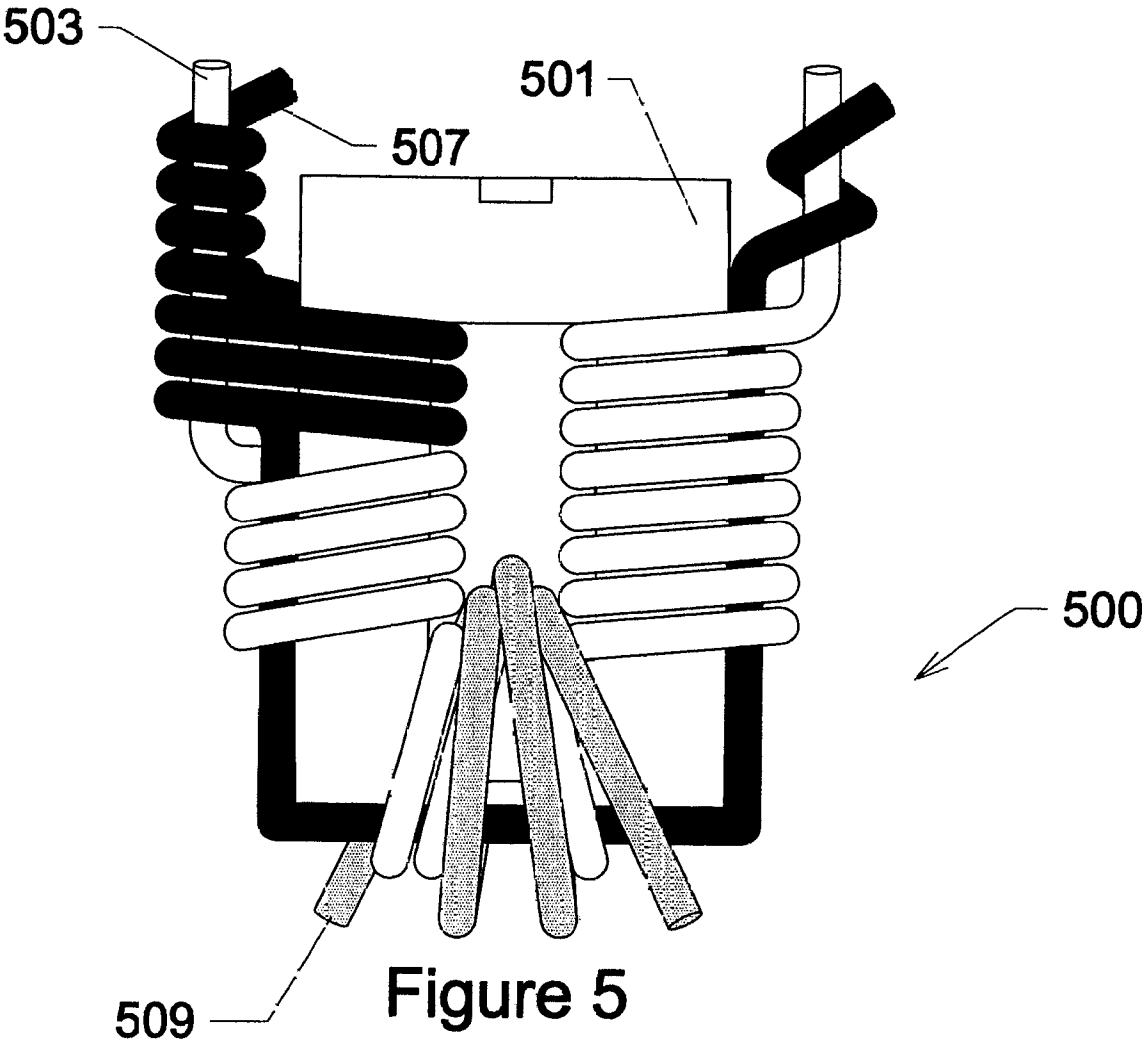
FIG. 5 illustrates one embodiment of a present invention iterative transformer with a single rectangular core and three windings.

FIG. 5 illustrates one embodiment of a present invention iterative transformer 500 with a single rectangular magnetic coil core 501 having a central orifice and three windings, namely, first wire 503, second wire 505 and third wire 507. They are wound as follows: The first wire has an incoming end and an outgoing end and is wrapped in a first plurality of windings around at least 40% of the core 501 through the central orifice, as shown. The second wire 505 has an incoming end and an outgoing end and is wrapped in a second plurality of windings around at least 10% of the core through the central orifice in an area separate from the first plurality of windings of first wire 503. As shown, one end of the second wire 505 is positioned under and through the first plurality of windings. The third wire 507 has an incoming end and an outgoing end and is wrapped in a third plurality of windings around at least 10% of the core 501 through the central orifice and over none, or a portion of at least one of said first wire and said second wire, and in this drawing specifically, over a portion of both the first wire 503 and the second wire 505. This particular arrangement may be used in, for example, single phase systems of moderate amperage, such as homes, and especially the system shown in FIG. 3 above.

Figure 6:
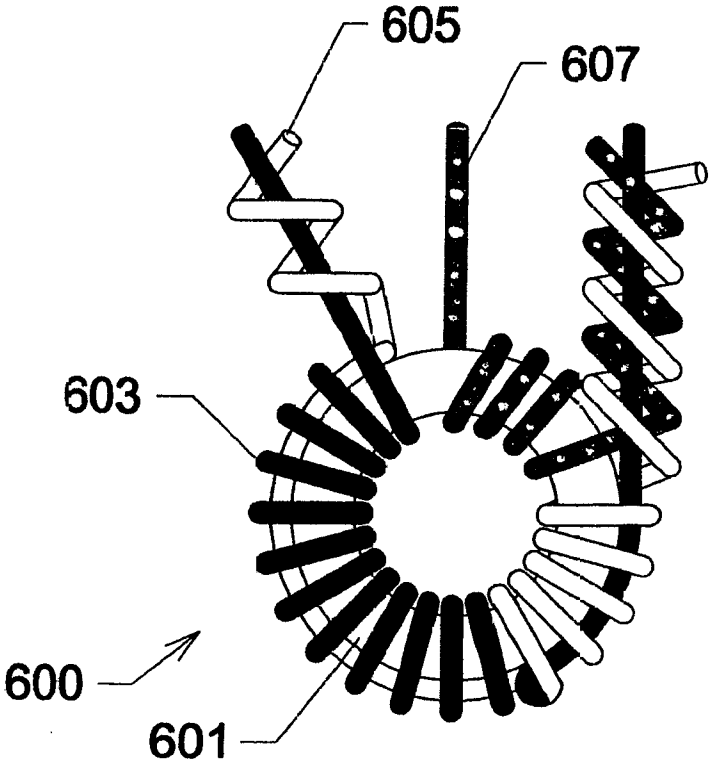
FIG. 6 illustrates one embodiment of a present invention iterative transformer with a single toroidal core and three windings.

FIG. 6 illustrates one embodiment of a present invention iterative transformer 600 with a single toroidal core 601 and three windings. The windings are with wires 603 (black), 605 (white) and 607 (grey). They are wound as follows: The first wire has an incoming end and an outgoing end and is wrapped in a first plurality of windings around at least 40% of the core 601 through the central orifice, as shown. The second wire 605 has an incoming end and an outgoing end and is wrapped in a second plurality of windings around at least 10% of the core through the central orifice in an area separate from the first plurality of windings of first wire 603. As shown, one end of the second wire 605 is positioned under and through the first plurality of windings. The third wire 607 has an incoming end and an outgoing end and, unlike the FIG. 5 illustration is wrapped in a third plurality of windings around at least 10% of the core 601 through the central orifice and over neither of said first wire and said second wire. This particular arrangement may be used in, for example, single phase systems of high amperage, such as large homes, small businesses and facilities that do not have service above single phase operations or have them on separate meters, i.e., on separate incoming lines.

Figure 8:
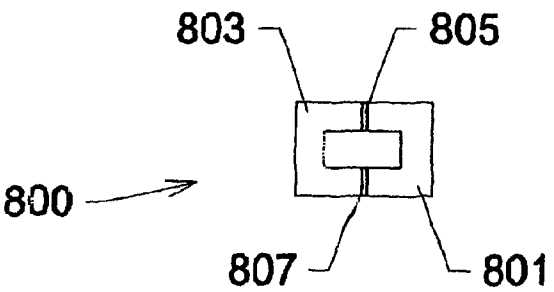
FIGS. 7, 8, 9 and 10 illustrate other types of magnetic cores that may be used in the present invention iterative transformers.
Figure 10:
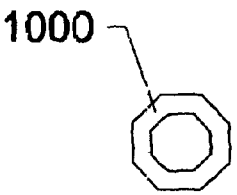
Figure 7:
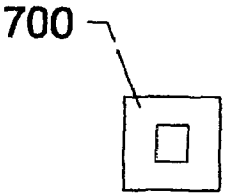
Figure 9:
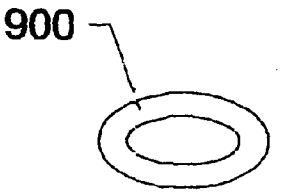

FIGS. 7, 8, 9 and 10 illustrate other types of magnetic cores that may be used in the present invention iterative transformers. FIG. 8 shows a split rectangular magnetic core 800 that includes a first half 801, a second half 803 and glue connections 805 and 807. The glue connections maintain desired spacing and keep the halves in the same plane. This might alternatively be accomplished by any other mechanical restraint, such as fittings, molded recesses, etc. FIG. 9 shows an oval magnetic core 900 and FIG. 10 shows a polygonal magnetic core 1000. Cross sections may also be varied, although rectangular, square, oval and circular cross sections are most commonly used.

Figure 11:
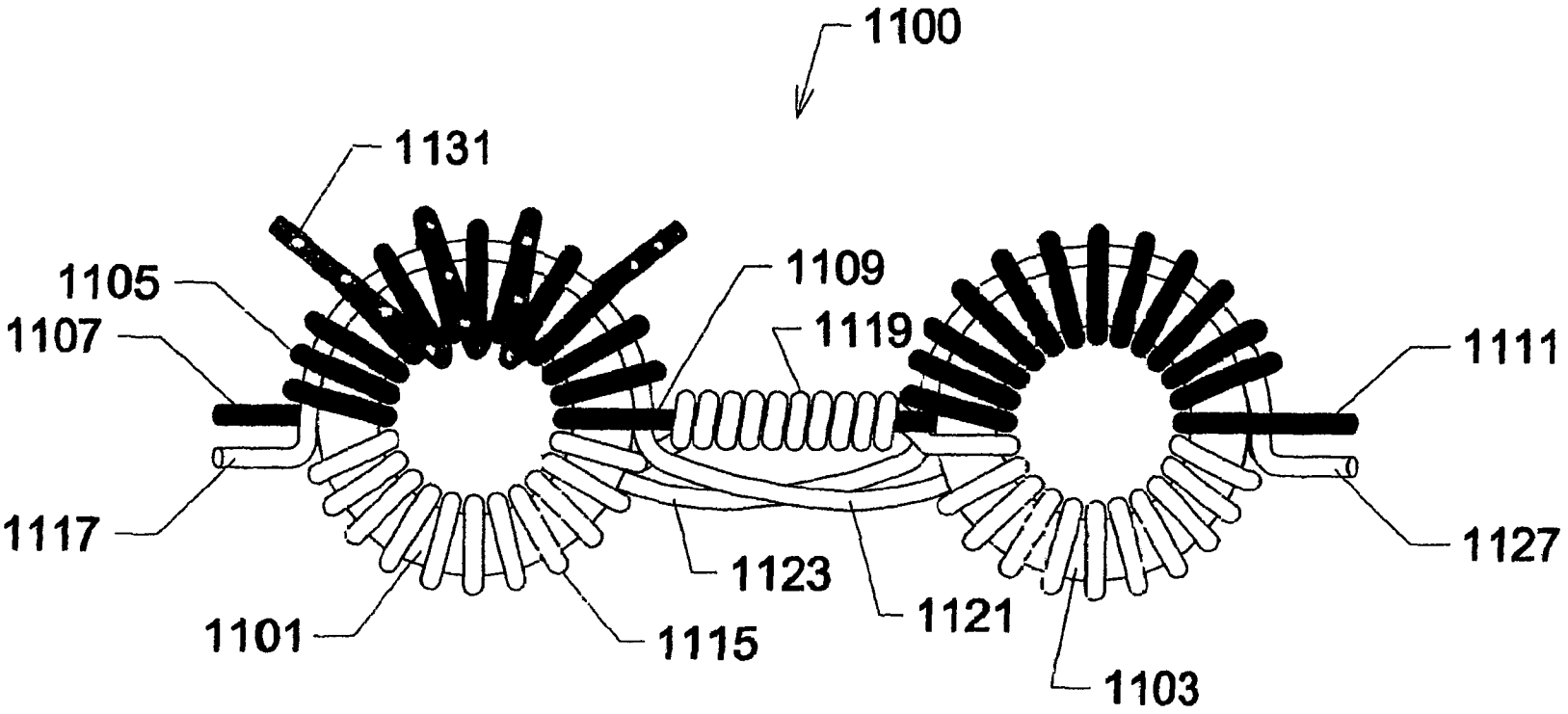
FIG. 11 shows a dual core present invention iterative transformer.

FIG. 11 shows a dual core present invention iterative transformer 1100 with a first magnetic coil core 1101 and a second magnetic coil core 1103, as well as a first wire 1105, a second wire 1115, and a third wire 1131. The first incoming wire 1105 has an incoming end 1107 and an outgoing end 1111, and being wrapped in a first plurality of windings around a portion of said first core 1101 and then linearly traversing a predetermined distance between and to said second core 1103 to establish a central linear first wire segment 1109 between said first and said second core 1101 and 1103, and then being wrapped in a second plurality of windings around a portion of said second core 1103 and continuing away from said core to its outgoing end 1111. The second incoming wire 1115 has an incoming end 1117 and an outgoing end 1127 and being positioned along a portion of the external periphery of said first core 1101 and under said first plurality of windings of said first incoming wire 1105, and then passing linearly at segment 1121 to said second core 1103 and then being wrapped in a plurality of windings around a portion of said second core 1103 away from and opposite said first incoming wire 1105 second plurality of windings, and then passing back toward said first core 1101 by being wound around said central linear first wire segment 1109 in a plurality of windings 1119 and then to said first core 1101 and being wrapped in a plurality of windings around a portion of first core 1101 away from said first incoming wire 1105 plurality of windings and continuing away from said first core 1101 at segment 1123 to return to said second core 1103 and being positioned along a portion of the external periphery of said second core 1103 and under said first plurality of windings of said first incoming wire 1105 on said second core 1103 and continuing away from said core 1103 to its outgoing end 1127. The third incoming wire 1131 is wrapped in a first plurality of windings around a portion of said first core 1101 and atop said first wire 1105 and said second wire 1115, as shown. This type of iterative transformer is used in two and three phase systems such as are shown in FIGS. 1 and 2 below.

Figure 12:
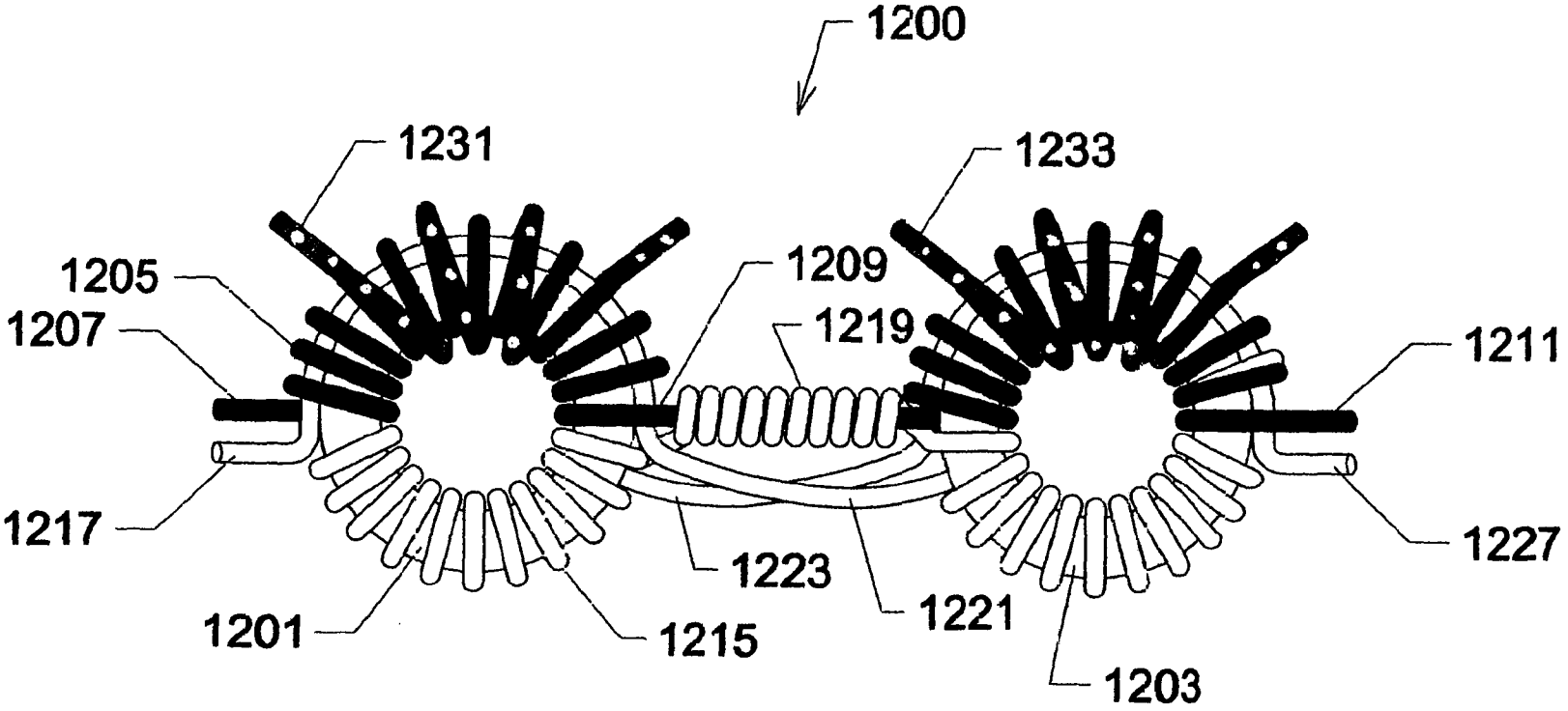
FIG. 12 shows another, different dual core present invention iterative transformer.

FIG. 12 shows a dual core present invention iterative transformer 1200 with a first magnetic coil core 1201 and a second magnetic coil core 1203, as well as a first wire 1205, a second wire 1215, and a third wire 1231 and a fourth wire 1233. The first incoming wire 1205 has an incoming end 1207 and an outgoing end 1211, and being wrapped in a first plurality of windings around a portion of said first core 1201 and then linearly traversing a predetermined distance between and to said second core 1203 to establish a central linear first wire segment 1209 between said first and said second core 1201 and 1203, and then being wrapped in a second plurality of windings around a portion of said second core 1203 and continuing away from said core to its outgoing end 1211. The second incoming wire 1215 has an incoming end 1217 and an outgoing end 1227 and being positioned along a portion of the external periphery of said first core 1201 and under said first plurality of windings of said first incoming wire 1205, and then passing linearly at segment 1221 to said second core 1203 and then being wrapped in a plurality of windings around a portion of said second core 1203 away from and opposite said first incoming wire 1205 second plurality of windings, and then passing back toward said first core 1201 by being wound around said central linear first wire segment 1209 in a plurality of windings 1219 and then to said first core 1201 and being wrapped in a plurality of windings around a portion of first core 1201 away from said first incoming wire 1205 plurality of windings and continuing away from said first core 1201 at segment 1223 to return to said second core 1203 and being positioned along a portion of the external periphery of said second core 1203 and under said first plurality of windings of said first incoming wire 1205 on said second core 1203 and continuing away from said core 1203 to its outgoing end 1227. The third incoming wire 1231 is wrapped in a first plurality of windings around a portion of said first core 1201 and atop said first wire 1205 and said second wire 1215, as shown. The fourth incoming wire 1233 is wrapped in a first plurality of windings around a portion of said second core 1203 and atop said first wire 1205 and said second wire 1215, as shown at core 1203. This type of iterative transformer is used in two and three phase systems such as are shown in FIGS. 1 and 2 below.

Figure 13:
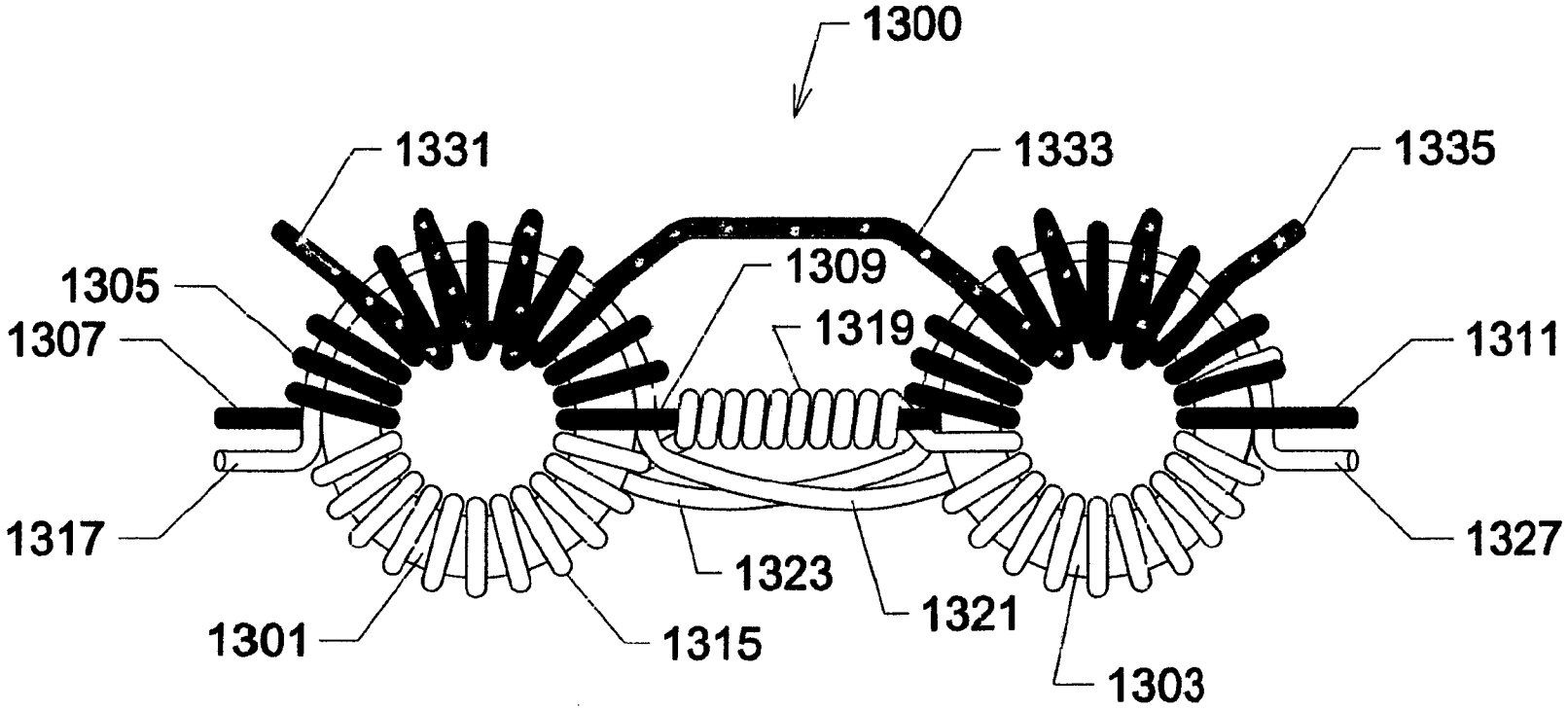
FIG. 13 shows another, different dual core present invention iterative transformer; and, FIG. 14 illustrates a triple core present invention iterative transformer.

FIG. 13 shows a dual core present invention iterative transformer 1300 with a first magnetic coil core 1301 and a second magnetic coil core 1303, as well as a first wire 1305, a second wire 1315, and a third wire 1331 and a fourth wire 1333. The first incoming wire 1305 has an incoming end 1307 and an outgoing end 1311, and being wrapped in a first plurality of windings around a portion of said first core 1301 and then linearly traversing a predetermined distance between and to said second core 1303 to establish a central linear first wire segment 1309 between said first and said second core 1301 and 1303, and then being wrapped in a second plurality of windings around a portion of said second core 1303 and continuing away from said core to its outgoing end 1311. The second incoming wire 1315 has an incoming end 1317 and an outgoing end 1327 and being positioned along a portion of the external periphery of said first core 1301 and under said first plurality of windings of said first incoming wire 1305, and then passing linearly at segment 1321 to said second core 1303 and then being wrapped in a plurality of windings around a portion of said second core 1303 away from and opposite said first incoming wire 1305 second plurality of windings, and then passing back toward said first core 1301 by being wound around said central linear first wire segment 1309 in a plurality of windings 1319 and then to said first core 1301 and being wrapped in a plurality of windings around a portion of first core 1301 away from said first incoming wire 1305 plurality of windings and continuing away from said first core 1301 at segment 1323 to return to said second core 1303 and being positioned along a portion of the external periphery of said second core 1303 and under said first plurality of windings of said first incoming wire 1305 on said second core 1303 and continuing away from said core 1303 to its outgoing end 1327. The third incoming wire 1333 has a first end 1331 and a second end 1335. It is wrapped in a first plurality of windings around a portion of said first core 1301 and atop said first wire 1305 and said second wire 1315, as shown. It continues across from the first core 1301 to the second core 1303 and is next wrapped in a second plurality of windings around a portion of said second core 1303 and atop said first wire 1305 and said second wire 1315, as shown at core 1303. Thus, this arrangement differs from the previous one in that the third wire of the first core is continued to the second core such that this one third wire replaces both the third and fourth wires of FIG. 12. This type of iterative transformer is used in two and three phase systems such as are shown in FIGS. 1 and 2 below.

Figure 14:
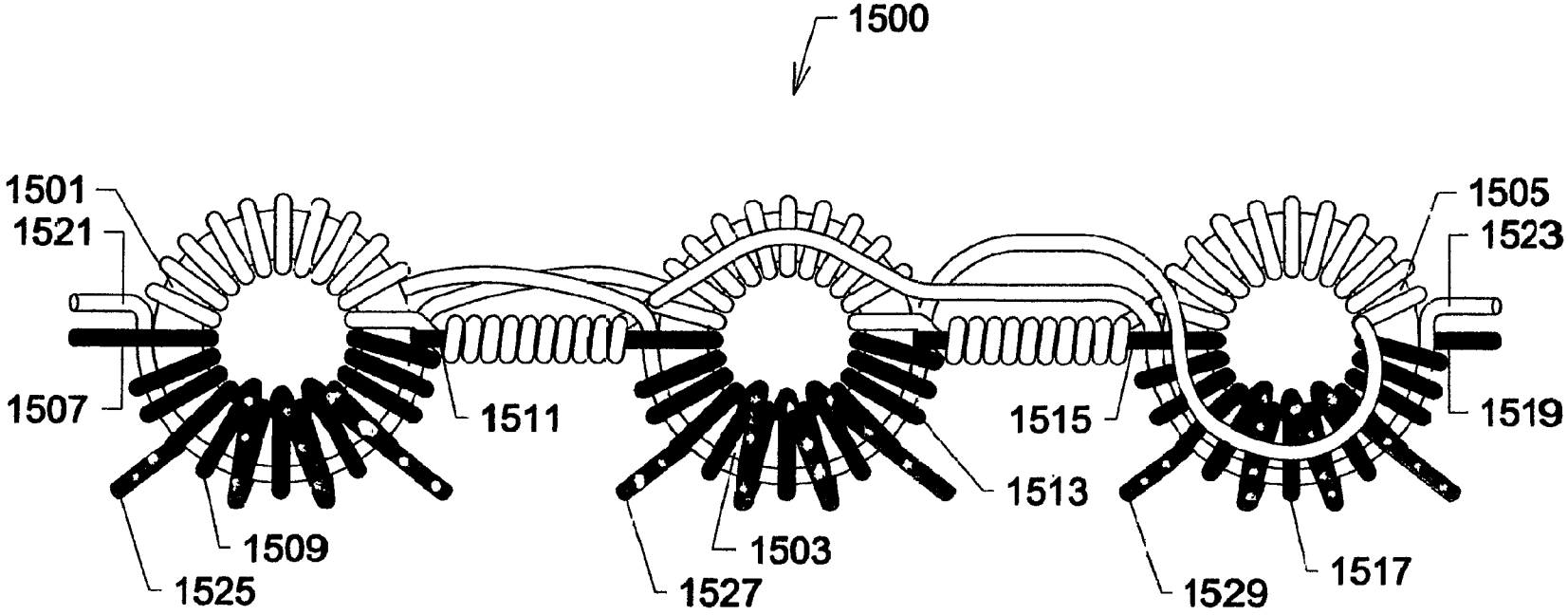

FIG. 14 illustrates a triple core present invention iterative transformer 1500. There is a first magnetic coil core 1501, a second magnetic coil core 1503, and a third magnetic coil core 1505. A first wire 1509 has a first end 1507 and a second end 1519, and is wound about a portion of first core 1501 at windings shown, travels linearly at segment 1511 to second core 1503 and is wound at windings 1513 about the second core 1503, and then travels linearly at segment 1515 to third core 1505, where it is wound at windings 1517 about the third core 1505 to end 1519. A second wire 1521 is positioned along a portion of the external periphery of said first core 1501 and under said first plurality of windings of said first incoming wire 1509, and then passing to said second core 1503 and then being wrapped in a plurality of windings around a portion of said second core 1503 away from and opposite said first incoming wire second plurality of windings 1513, and then passing linearly to said third core 1505 and then being wrapped in a plurality of windings around a portion of said third core 1505 away from and in the same direction as said first incoming wire plurality of windings 1517 and continuing away from said third core 1505. It then returns to the second core 1503 and travels under the second core first wire windings 1513 along a portion of the external periphery of said second core 1503, and then to said first core 1501 where it is wound about said first core 1501. It then passes to said third core 1505 and travels under the third core first wire windings 1517 along a portion of the external periphery of said third core 1505 exiting to end 1523. The third wire 1525 is wrapped in a first plurality of windings around a portion of said first core 1501 and atop said first wire 1509 and said second wire 1521, as shown. A fourth wire 1527 is wrapped in a plurality of windings around a portion of said second core 1503 and atop said first wire 1509 and said second wire 1521, as shown. A fifth wire 1529 is wrapped in a plurality of windings around a portion of said third core 1505 and atop said first wire 1509 and said second wire 1521, as shown. Alternatively, any of third wire 1525, fourth wire 1527 and fifth wire 1529 could be connected to one another without exceeding the scope of the present invention. Likewise, the sequence of windings could change regarding the first and second wires, as long as the second wire is both separately wound on each core and also extends under the first and second wires on each core.

Figure 15:
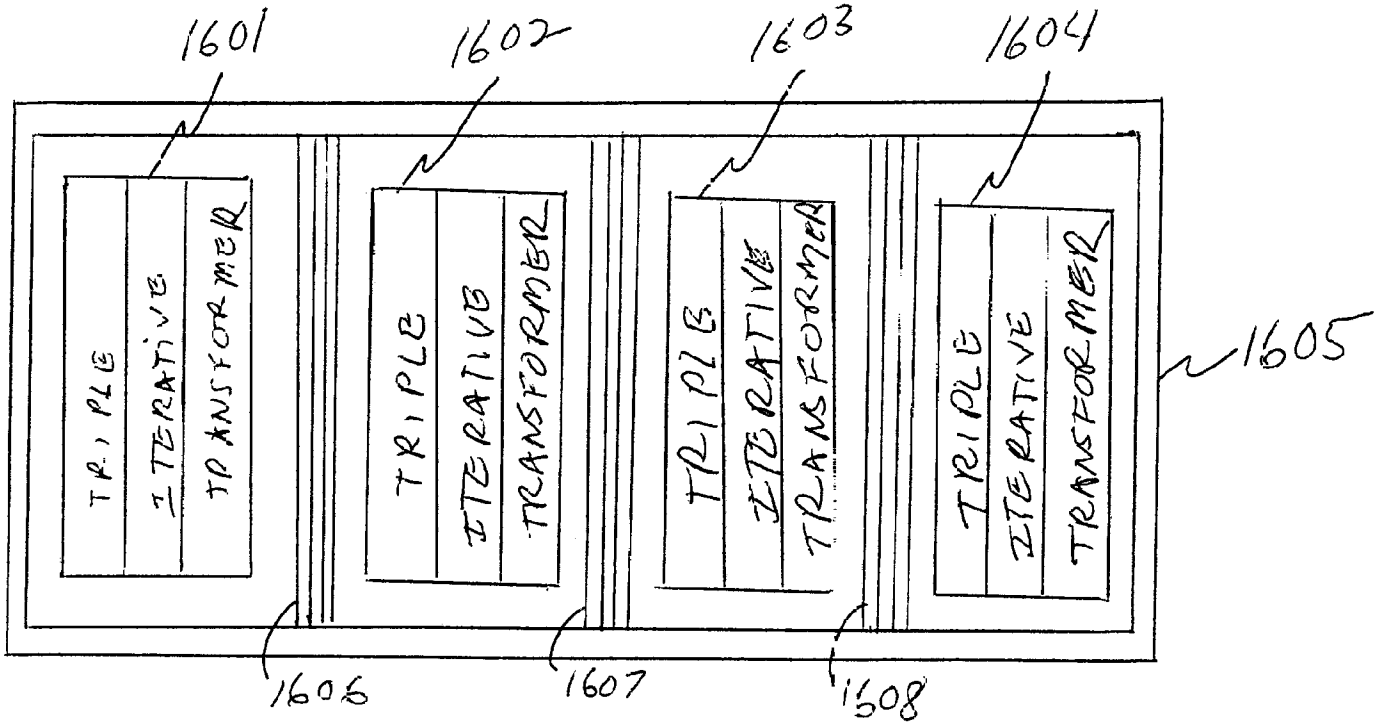
FIG. 15 shows a top view of a present invention device with a bin and component divider walls.

In one implementation of the present invention, referring to FIG. 15, these units 1601, 1602, 1603 and 1604 are mounted in a main housing or bin 1605 with dividers 1606, 1607 and 1608, made of insulative layer/aluminum/insulative layer used to separate the coils from each other. The insulative layers may be made of plastic, fiberglass, paper or other insulative material, or composites thereof.

Relevant/Related Concepts

The following discussion is provided to further elaborate on concepts relevant to various aspects of the present invention.

Positive sequence harmonics—such harmonics try to make a motor run faster than the fundamental. Negative sequence harmonics—such harmonics try to make the motor run slower than the fundamental. In both cases the motor loses torque and heats up. Changing power supplies can affect or disrupt normal harmonics. Abnormal harmonics can also cause transformers and motors to overheat. Even harmonics problems will disappear if waveforms are symmetrical, i.e., as equally positive and negative. Zero sequence current harmonics add in Neutral conductors. This can cause these conductors to also overheat.

Current distortion is expected in a system with non-linear loads like DC power supplies. In a typical case, when the current distortion starts to cause voltage distortion (THD) of more than 5%, this signals a potential problem.

K-factor indicates the amount of harmonic currents and can help in selecting transformers. K-factor may be considered along with apparent power (kVA) to select a replacement transformer to handle non-linear, harmonics-rich loads. K-factor is a mathematically derived value that takes into account the effects of harmonics on transformer loading and losses. Voltage and frequency should be close to the applicable nominal values: 120 V, 230 V, 480 V; 60 Hz, or 50 Hz, although 40 Hz to 400 Hz frequency range conditions may experience significant improvements with the present invention systems. For example: Checking the voltages and currents to see if the power applied to a three phase induction motor is in balance. Each of the phase voltages should not differ more than 1% from the average of the three. Current unbalance should not typically exceed 10%. Voltage unbalance causes high unbalanced currents in stator windings, resulting in overheating and reduced motor life. If unbalance is too high, other correction modes may be used to further adjust with the use of the heretofore described present invention system in the power system.

Typically, crest factor close to 2.0 indicates high distortion. A pure sine wave would have a crest factor of 1.414. Anything higher is a result of distortion in the lines and feeding also back to the incoming power source this is also maintained with the EBU system installed.

Dips (sags) and swells may indicate a weak power distribution system. In a weak system, voltage will change considerably when a big motor or a welding machine is switched on or off. This may cause lights to flicker or even show visible dimming. It can also cause reset and data loss in computer systems and process controllers. By monitoring the voltage and current trend at the power service entrance, it is possible to determine if the cause of the voltage dip is inside or outside the building. The cause is inside the building (downstream) when voltage drops while current rises; it is outside (upstream) when both voltage and current drop. The final storage of the present invention corrects this problem.

Transients in a power distribution system can cause many types of equipment to malfunction. Equipment subjected to repeated transients can eventually fail Events occur intermittently, making it desirable to monitor the system for a period of time to locate them. Voltage transients can be monitored when electronic power supplies are flailing repeatedly or if computers reset spontaneously. To isolate the fault location, it is possible to use the transients function and monitor at several points in the distribution. Working down the line, circuits can be eliminated that don't show events where as further monitoring should be initiated for circuits that show the event in sharper detail. The sharper the event, the closer to identify the load causing the problem and as the unit monitoring will also isolate this allowing determination if it is a single, dual or three phase load causing the problem, further reducing the number of culprits in the building.

The voltages and currents in the Unbalance table can be used to check if applied power is in balance; for example, on a three phase induction motor. Voltage unbalance causes high unbalanced currents in stator windings, resulting in overheating and reduced motor life. Each of the phase voltages should not differ more than 1% from the average of the three. Current unbalance should not exceed 10%. If unbalance is too high, the use of the present invention will act as a stabilizer to the power system. Each phase voltage or current can be split into three components: positive sequence, negative sequence, and zero sequence. The positive sequence is the normal component present in balanced 3-phase systems. The negative sequence results from unbalanced phase-to-phase currents and voltages. For instance, this component causes a 'braking' effect in three phase motors, resulting in overheating and life reduction. Zero sequence may appear in an unbalanced load in 4 wire power systems and represents the current in the N (Neutral) wire. Unbalance exceeding 2% is considered too high Inrush is the large spike most commonly caused by a motor load coming on-line. As it first energizes, the motor utilizes a higher amount of current than when runs at a constant speed. This large current draw frequently causes a large enough voltage dip to send other equipment off-line or cause the lights to blink. The inrush is capped with the present invention and allows the inrush magnitude along with the length of time it takes the motor to come up to speed. If the inrush exceeds the breaker setting, it nominally will trip but the present invention will stabilize the problem and the storage in the device will hold the power for a much longer time for the correction of this problem.

The present invention, as indicated above, uses unique grounding (Green line ground at the iterative transformers), in addition to other unique features and component arrangements, to achieve unexpectedly favorable performance results. When these grounds are arranged in the foregoing manner, additional energy savings is realized. That is, the reduction of energy consumption is enhanced. Thus, failure to ground the transformers as indicated may adversely affect the system's ability to maximize reduction in energy consumption. The combinations of the third coil core and windings, the changes in the capacitor arrangements with dedicated resistors and the unique groundings are surprisingly synergistic and increase response speed and efficiencies of the system, including active filtering.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A system for reducing electrical consumption utilizing a triple core iterative transformer device, comprises:

a.) connecting means for connection to an incoming power supply, for connection in parallel, including a hot line and a neutral line, and at least one ground, and having the following components connected between said hot line and said neutral line, in the following order;

b.) at least one front capacitor of predetermined capacitance, with a resistor;

c.) at least two front arc suppressors;

d.) at least one front metal oxide varistor line transient voltage surge suppressor having a predetermined number of joules capability to suppress undesired power spikes;

e.) at least two inductor/metal oxide varistor iterative transformers;

f.) at least a second capacitor of its own predetermined capacitance;

g.) at least one metal oxide varistor having a predetermined number of joules capability;

h.) at least two capacitors, each with a resistor, each of said at least two capacitors, each having its own predetermined capacitance different from one another;

wherein said at least two inductor/metal oxide varistor iterative transformers include a three component iterative transformer having:

I.) a first magnetic coil core;

II.) a second magnetic coil core;

III.) a third magnetic coil core;

IV.) a first incoming wire being wrapped around a portion of each of said first, second and third magnetic coil cores;

V.) a second incoming wire being wrapped around a portion of each of said first, second and third magnetic coil cores; and, VI.) a third incoming wire being wrapped around a portion of each of said first, second and third magnetic coil cores.

2. The system for reducing electrical consumption device of claim 1 wherein said three component iterative transformer includes:

I.) said first magnetic coil core being selected from the group consisting of a one piece loop and a multi-piece loop;

II.) said second magnetic coil core being selected from the group consisting of a one piece loop and a multi-piece loop;

III.) said third magnetic coil core being selected from the group consisting of a one piece loop and a multi-piece loop;

IV.) said first incoming wire being wrapped in a first plurality of windings around a portion of said first magnetic coil core and then traversing a predetermined distance between and to said second magnetic coil core and then being wrapped in a second plurality of windings around a portion of said second magnetic coil core and continuing away from said second magnetic coil core and then traversing a predetermined distance between and to said third magnetic coil core and then being wrapped in a third plurality of windings around a portion of said third magnetic coil core and continuing away from said third magnetic coil core;

V.) a second incoming wire being positioned along a portion of the external periphery of said first magnetic coil core and under said first plurality of windings of said first incoming wire, and then passing linearly to said second magnetic coil core and then being wrapped in a plurality of windings around a portion of said second magnetic coil core away from and opposite said first incoming wire second plurality of windings, and then passing linearly to said third magnetic core and then being wrapped in a plurality of windings around a portion of said third magnetic coil core away from and in the same direction as said first incoming wire plurality of windings and continuing away from said third magnetic coil core;

VI.) a third incoming wire being wrapped in a first plurality of windings around a portion of said first magnetic coil core and then traversing a predetermined distance between and to said second magnetic coil core and then being wrapped in a second plurality of windings around a portion of said second circular magnetic coil core and continuing away from said second circular magnetic coil core and then traversing a predetermined distance between and to said third magnetic coil core and then being wrapped in a third plurality of windings around a portion of said third magnetic coil core and continuing away from said third magnetic coil core, wherein said third incoming wire is positioned as to each of said first and second incoming wires in a position selected from the group consisting of atop;

adjacent; under and combinations thereof.

3. The system for reducing electrical consumption device of claim 1 wherein said at least one front metal oxide varistor is a plurality of varistors in parallel.

4. The system for reducing electrical consumption of claim 1 wherein said at least one metal oxide varistor is a plurality of varistors in parallel.

5. The system for reducing electrical consumption of claim 1 wherein said at least a second capacitor is a plurality of capacitors having different capacitances.

6. The system for reducing electrical consumption of claim 1 wherein said components are arranged for operating as a single phase device.

7. The system for reducing electrical consumption of claim 1 further including a ground line emanating from said three component iterative transformer.

8. The system for reducing electrical consumption of claim 1 wherein said components are duplicated to create two connected scts thereof and are arranged for operation as a two phase device.

9. The system for reducing electrical consumption of claim 8 further including the following components: i.) at least one resistor having a predetermined resistance.

10. The system for reducing electrical consumption of claim 1 wherein said components are triplicated therein to form three connected sets thereof and are arranged as a three phase device, and further wherein each set of said triplicated components last at least two capacitors is at least three capacitors, each having its own predetermined capacitance different from one another.

11. The system for reducing electrical consumption of claim 10 further including the following components: i.) at least one resistor having a predetermined resistance.

12. A three component iterative transformer, which comprises:

a.) a first magnetic coil core;

b.) a second magnetic coil core;

c.) a third magnetic coil core;

d.) a first incoming wire being wrapped in a first plurality of windings around a portion of said first magnetic coil core and then traversing a predetermined distance between and to said second magnetic coil core and then being wrapped in a second plurality of windings around a portion of said second magnetic coil core and continuing away from said second magnetic coil core and then traversing a predetermined distance between and to said third magnetic coil core and then being wrapped in a third plurality of windings around a portion of said third magnetic coil core and continuing away from said third magnetic coil core;

e.) a second incoming wire being positioned along a portion of the external periphery of said first magnetic coil core and under said first plurality of windings of said first incoming wire, and then passing linearly to said second magnetic coil core and then being wrapped in a plurality of windings around a portion of said second magnetic coil core away from and opposite said first incoming wire second plurality of windings, and then passing linearly to said third magnetic core and then being wrapped in a plurality of windings around a portion of said third magnetic coil core away from and in the same direction as said first incoming wire plurality of windings and continuing away from said third magnetic coil core;

f.) a third incoming wire being wrapped in a first plurality of windings around a portion of said first magnetic coil core and then traversing a predetermined distance between and to said second magnetic coil core and then being wrapped in a second plurality of windings around a portion of said second circular magnetic coil core and continuing away from said second circular magnetic coil core and then traversing a predetermined distance between and to said third magnetic coil core and then being wrapped in a third plurality of windings around a portion of said third magnetic coil core and continuing away from said third magnetic coil core, wherein said third incoming wire is wrapped relative to each of said first and second incoming wires in a wound position selected from the group consisting of atop; adjacent; under and combinations thereof.

13. The three component iterative transformer of claim 12 wherein said first magnetic coil core and said second magnetic coil core and said third magnetic coil core are split half-rectangles of equal size.

14. The three component iterative transformer of claim 12 wherein said second incoming wire, after its first plurality of windings and before its second plurality of windings, is positioned atop said first plurality of windings of said first incoming wire.

15. The three component iterative transformer of claim 12 wherein said first incoming wire is a black or colored wire having an inductance within the range of about 1.0 to about 37 millihenries, plus or minus ten percent and the second incoming wire is a white wire having an inductance of about 1.0 to about 37 millihenries, plus or minus ten percent.

16. The three component iterative transformer of claim 12 wherein said first incoming wire and said second incoming wire, and said third incoming wire are all wires of the same gauge.

17. A device for multiple three component iterative transformers, which comprises:

a main housing having a plurality of bins, each of said plurality of bins having a three component iterative transformer therein, each of said bins being separated by one or more divider walls with non-conductive materials, each said three component iterative transformer including:

a.) a first magnetic coil core;

b.) a second magnetic coil core;

c.) a third magnetic coil core;

d.) a first incoming wire being wrapped in a first plurality of windings around a portion of said first magnetic coil core and then traversing a predetermined distance between and to said second magnetic coil core and then being wrapped in a second plurality of windings around a portion of said second magnetic coil core and continuing away from said second magnetic coil core and then traversing a predetermined distance between and to said third magnetic coil core and then being wrapped in a third plurality of windings around a portion of said third magnetic coil core and continuing away from said third magnetic coil core;

e.) a second incoming wire being positioned along a portion of the external periphery of said first magnetic coil core and under said first plurality of windings of said first incoming wire, and then passing linearly to said second magnetic coil core and then being wrapped in a plurality of windings around a portion of said second magnetic coil core away from and opposite said first incoming wire second plurality of windings, and then passing linearly to said third magnetic core and then being wrapped in a plurality of windings around a portion of said third magnetic coil core away from and in the same direction as said first incoming wire plurality of windings and continuing away from said third magnetic coil core;

f.) a third incoming wire being wrapped in a first plurality of windings around a portion of said first magnetic coil core and then traversing a predetermined distance between and to said second magnetic coil core and then being wrapped in a second plurality of windings around a portion of said second circular magnetic coil core and continuing away from said second circular magnetic coil core and then traversing a predetermined distance between and to said third magnetic coil core and then being wrapped in a third plurality of windings around a portion of said third magnetic coil core and continuing away from said third magnetic coil core, wherein said third incoming wire is wrapped relative to each of said first and second incoming wires in a wound position selected from the group consisting of atop; adjacent; under and combinations thereof.

18. The system for reducing electrical consumption of claim 17 wherein said divider walls include grounded aluminum plates.

19. The system for reducing electrical consumption of claim 18 wherein said non-conductive materials are composite deck boards.

20. The system for reducing electrical consumption of claim 19 wherein said divider walls include a grounded aluminum plate sandwiched between insulative composite deck boards wherein each insulative composite deck board is about 1/16.sup.th to 3/16.sup.th inches thick.

* * * * *